US011866666B1

(12) United States Patent
Nagu et al.

(10) Patent No.: US 11,866,666 B1
(45) Date of Patent: Jan. 9, 2024

(54) METHODS FOR CORROSION REDUCTION IN PETROLEUM TRANSPORTATION AND STORAGE

(71) Applicant: Saudi Arabian Oil Company, Dhahran (SA)

(72) Inventors: Muthukumar Nagu, Dhahran (SA); Muhammad Imran Ul-Haq, Dhahran (SA); Nayef M. Alanazi, Dhahran (SA); Talal Y. Zahrani, Dahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/157,463

(22) Filed: Jan. 20, 2023

(51) Int. Cl.
*C10L 10/04* (2006.01)
*C10L 1/185* (2006.01)
*C10L 3/12* (2006.01)

(52) U.S. Cl.
CPC ..... *C10L 10/04* (2013.01); *C10L 1/1855* (2013.01); *C10L 3/12* (2013.01); *C10L 2230/08* (2013.01); *C10L 2270/10* (2013.01)

(58) Field of Classification Search
CPC ..... C10L 10/04; C10L 1/1855; C10L 3/12; C10L 2230/08; C10L 2270/10
USPC ..... 585/5
See application file for complete search history.

(56) References Cited

U.S. PATENT DOCUMENTS 2,668,100 A 2/1954 Luviski
2,736,658 A 2/1956 Pfohl et al.
2,955,083 A 10/1960 Levin et al.
3,283,005 A 11/1966 Abend et al.
3,365,477 A 1/1968 Gee et al.
3,623,979 A 11/1971 Maddox, Jr. et al.
3,629,104 A 12/1971 Maddox, Jr. et al.
3,981,682 A 9/1976 Ward et al.
4,028,117 A 6/1977 Moat
4,148,605 A 4/1979 Andrews, Jr.
4,214,876 A 7/1980 Garth et al.
4,469,873 A * 9/1984 Nieh ..... C07D 213/20 546/344
4,515,708 A 5/1985 Haselgrave et al.
4,637,899 A * 1/1987 Kennedy, Jr. ..... C11D 3/0073 510/480
4,672,118 A 6/1987 Fisk et al.
4,673,436 A 6/1987 Haselgrave et al.
4,734,277 A 3/1988 Login
4,744,948 A 5/1988 Incorvia
4,784,796 A 11/1988 Treybig et al.
4,812,263 A 3/1989 Login
(Continued)

FOREIGN PATENT DOCUMENTS

CA 2196650 A1 8/1998
EP 1690960 A2 8/2006
(Continued)

*Primary Examiner* — Prem C Singh
*Assistant Examiner* — Francis C Campanell
(74) *Attorney, Agent, or Firm* — DINSMORE & SHOHL

(57) ABSTRACT

According to embodiments disclosed herein, a method of reducing corrosion during petroleum transportation, petroleum storage, or both, may comprise inputting a corrosion inhibitor formulation into a petroleum pipeline, a petroleum storage tank, or both, wherein the corrosion inhibitor formulation consists essentially of solvent and a pyridinium hydroxyl alkyl ether compound.

12 Claims, 5 Drawing Sheets

(56) References Cited

U.S. PATENT DOCUMENTS

| | | | |
|---|---|---|---|
| 5,000,873 | A | 3/1991 | Fisk et al. |
| 5,130,034 | A | 7/1992 | Williams et al. |
| 5,209,859 | A | 5/1993 | Williams et al. |
| 5,292,480 | A | 3/1994 | Fischer et al. |
| 5,336,441 | A | 8/1994 | Shah et al. |
| 5,611,991 | A | 3/1997 | Naraghi |
| 5,756,004 | A | 5/1998 | Brezinski |
| 5,763,368 | A | 6/1998 | Brezinski |
| 5,993,693 | A | 11/1999 | Meyer |
| 6,118,000 | A | 9/2000 | Frenier |
| 6,303,079 | B1 | 10/2001 | Meyer |
| 6,315,045 | B1 | 11/2001 | Brezinski |
| 7,057,050 | B2 | 6/2006 | Meyer |
| 7,951,754 | B2 | 5/2011 | Tiwari et al. |
| 8,933,000 | B2 | 1/2015 | Walker |
| 9,074,289 | B2 | 7/2015 | Malwitz et al. |
| 9,238,588 | B2 | 1/2016 | Harrington et al. |
| 9,382,467 | B2 | 7/2016 | Meyer et al. |
| 9,434,911 | B2 | 9/2016 | Bennett et al. |
| 9,816,024 | B2 | 11/2017 | Jafar Mazumder et al. |
| 9,868,894 | B1 | 1/2018 | Jafar Mazumder et al. |
| 10,221,368 | B2 | 3/2019 | Benitez Aguilar et al. |
| 10,323,327 | B2 | 6/2019 | Obot et al. |
| 10,563,114 | B2 | 2/2020 | Mandal et al. |
| 10,604,710 | B2 | 3/2020 | Moloney |
| 10,626,319 | B1 | 4/2020 | Obot et al. |
| 10,920,534 | B2 | 2/2021 | Dobler et al. |
| 11,518,932 | B2 | 12/2022 | Quraishi et al. |
| 2002/0030018 | A1 | 3/2002 | Brezinski |
| 2006/0013798 | A1 | 1/2006 | Henry et al. |
| 2007/0010404 | A1 | 1/2007 | Welton et al. |
| 2010/0219379 | A1 | 9/2010 | Acosta et al. |
| 2011/0100630 | A1 | 5/2011 | Evans et al. |
| 2013/0233543 | A1 | 9/2013 | Overkempe et al. |
| 2016/0177170 | A1 | 6/2016 | Janak et al. |
| 2016/0177226 | A1* | 6/2016 | Bennett ..... C23G 1/06 510/188 |
| 2016/0237334 | A1 | 8/2016 | Gunawan et al. |
| 2018/0282606 | A1 | 10/2018 | Rodgers et al. |
| 2020/0033987 | A1 | 1/2020 | Fu |
| 2020/0318243 | A1 | 10/2020 | Obot et al. |
| 2020/0362227 | A1 | 11/2020 | Obot et al. |

FOREIGN PATENT DOCUMENTS

| | | | | |
|---|---|---|---|---|
| GB | 2196749 | A * | 5/1988 | ..... G03F 7/0285 |
| WO | 9933953 | A1 | 7/1997 | |
| WO | 2006034101 | A1 | 3/2006 | |

* cited by examiner

METHODS FOR CORROSION REDUCTION IN PETROLEUM TRANSPORTATION AND STORAGE

TECHNICAL FIELD

The present disclosure relates to corrosion-resistance and, more specifically, to a method of reducing corrosion in petroleum transportation and storage applications using a corrosion inhibitor formulation.

BACKGROUND

Corrosion is an issue for many materials when they interact with their environments over time. For example, the presence of species such as $H_2S$, $CO_2$, organic acids, and brine solutions in produced oil may create a corrosive environment for transportation pipelines and oil storage units in an oil and gas facility. Specifically, when $CO_2$ and $H_2S$ are dissolved in water, these species may behave like weak acids and promote the corrosion of steel, thus resulting in damage to the internal walls of the transportation pipelines and oil processing units and causing leaks that will increase the maintenance time and costs associated with the oil and gas processing. Many conventional compounds may be used in corrosion inhibitors and corrosion-resistant films in order to reduce corrosion of surfaces. However, these conventional compounds are often toxic and non-biodegradable. Additionally, there is a relatively high cost associated with the production of these conventional compounds. Further, these conventional compounds do not sufficiently resist the corrosive effects present in a wet sour environment (i.e., an environment rich in $H_2S$), which are often present in crude oil processing facilities. As such, new methods are needed in corrosion reduction.

SUMMARY

Described herein is a method of reducing corrosion during petroleum transportation, storage, or both. The method comprises inputting a corrosion inhibitor formulation into a petroleum pipeline, storage tank, or both, wherein the corrosion inhibitor formulation consists essentially of solvent and a pyridinium hydroxyl alkyl ether compound. The presence of pyridinium hydroxyl alkyl ether compounds in a corrosion inhibitor solution may result in relatively high corrosion-resistant properties in a wet sour environment when compared to conventional compounds with no corrosion-resistant film. Further, using pyridinium hydroxyl alkyl ether compounds in a corrosion inhibitor solution may reduce the cost associated with the production of corrosion inhibitor solutions. Also, a pyridinium hydroxyl alkyl ether compound in the corrosion inhibitor solution may be less toxic than conventional compounds present in corrosion inhibitor solutions and corrosion-resistant films.

According to one or more embodiments of the present disclosure, a method of reducing corrosion during petroleum transportation, petroleum storage, or both, may comprise inputting a corrosion inhibitor formulation into a petroleum pipeline, a petroleum storage tank, or both, wherein the corrosion inhibitor formulation consists essentially of solvent and a pyridinium hydroxyl alkyl ether compound. The pyridinium hydroxyl alkyl ether compound may have the general formula:

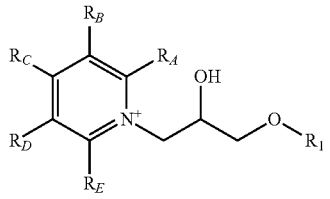

$R_1$ may be a $C_1$-$C_{18}$ alkyl group, a $C_1$-$C_{18}$ hydroxyl alkyl group, a $C_1$-$C_{18}$ alkenyl group, a $C_1$-$C_{18}$ alkynl group, a $C_1$-$C_{18}$ acryl group, a $C_1$-$C_{18}$ cycloalkyl group, or a $C_1$-$C_{18}$ functional alkyl group and $R_A$, $R_B$, $R_C$, $R_D$, and $R_E$ may each independently be chosen from hydrogen, a $C_1$-$C_{18}$ alkyl group, a $C_1$-$C_{18}$ hydroxyl alkyl group, a $C_1$-$C_{18}$ alkenyl group, a $C_1$-$C_{18}$ alkynl group, a $C_1$-$C_{18}$ acryl group, a $C_1$-$C_{18}$ cycloalkyl group, or a $C_1$-$C_{18}$ functional alkyl group.

According to one or more embodiments of the present disclosure, the $C_1$-$C_{18}$ functional alkyl group may comprise a moiety chosen from a carboxyl group, an amine group, or a thiol group.

According to one or more embodiments of the present disclosure, the petroleum may comprise any of gasoline, diesel, kerosene, or jet fuel.

These and other embodiments are described in more detail in the detailed description. It is to be understood that both the foregoing general description and the following detailed description present embodiments of the presently disclosed technology, and are intended to provide an overview or framework for understanding the nature and character of the presently disclosed technology as it is claimed. The accompanying drawings are included to provide a further understanding of the presently disclosed technology and are incorporated into and constitute a part of this specification. The drawings illustrate various embodiments and, together with the description, serve to explain the principles and operations of the presently disclosed technology. Additionally, the drawings and descriptions are meant to be merely illustrative, and are not intended to limit the scope of the claims in any manner.

BRIEF DESCRIPTION OF THE DRAWINGS

The following detailed description of specific embodiments of the present disclosure can be best understood when read in conjunction with the following drawings, where like structure is indicated with like reference numerals and wherein.

DETAILED DESCRIPTION

The present disclosure is directed to methods of reducing corrosion made from corrosion inhibitor solutions and corrosion-resistant substrates that comprise substrates having a first surface and corrosion-resistant films positioned on at least a portion of the As described herein, corrosion refers to a method in which a material is oxidized by substances in the environment that causes the material to lose electrons and deteriorates at least a portion of the material. The term "corrosion-resistant" generally refers to the resistance that a material has against corrosion.

Figure 1:
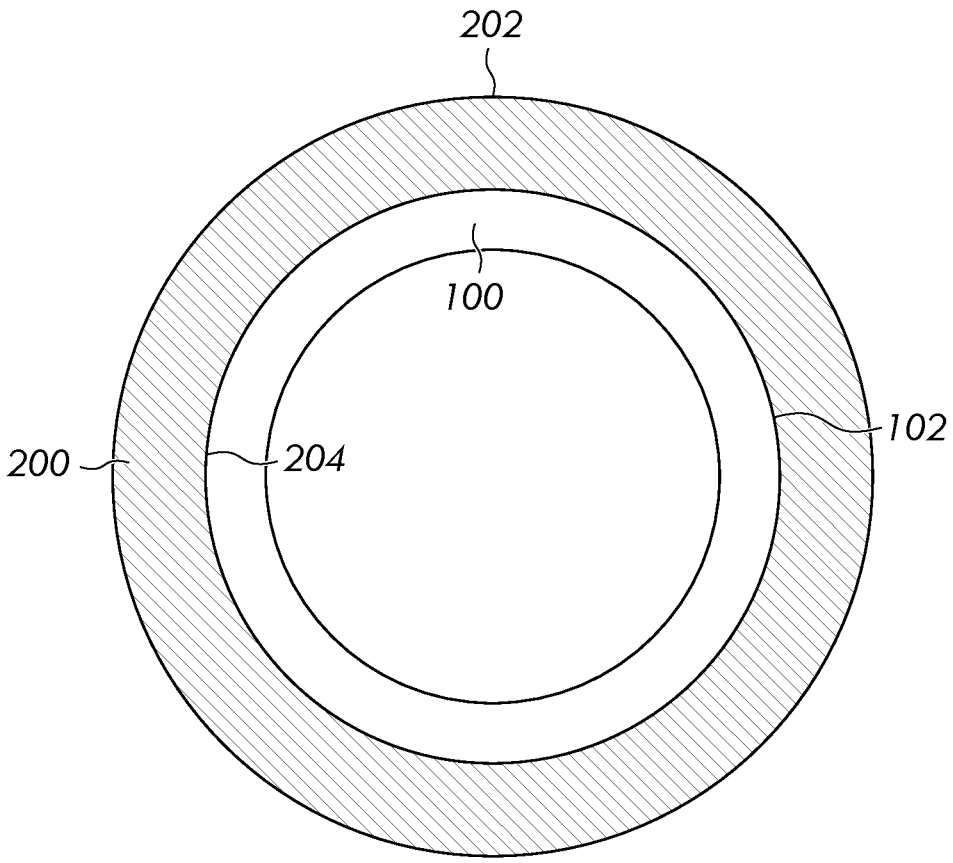
FIG. 1 schematically depicts a cross-sectional view cut in the axial direction of a metal pipe comprising a corrosion inhibitor formulation, according to one or more embodiments shown and described herein.

Now, referring to FIG. 1, in one or more embodiments, the pipeline 200 may be a metal pipe that comprises at least a first surface 204 and a second surface 202. The term "pipe" may refer to a tubular hollow cylinder having a circular, or near circular, cross section that is used to transport substances (for example liquids, gases, slurries, powders, small solids, etc.). The metal pipe may comprise one or more metals and one or more surfaces of the metal pipe may comprise metal oxides. For example, the metal pipe may comprise carbon steel. In some embodiments, the first surface 204 of the metal pipe may be the internal surface of the metal pipe, and the pipe may further comprise an outer surface 202. The term "internal surface" may refer to the surface of the inside of the metal pipe that is enclosed within the tubular cylinder of the metal pipe. For example, when the substrate 200 is a metal pipe and the first surface 204 is the internal surface of the metal pipe, the first surface 102 of the corrosion inhibitor compound 100 may be in direct contact with the internal surface of the metal pipe. Without being bound by a theory, it is believed that the corrosion inhibitor compound 100 being in direct contact with a least a portion of the internal surface of the metal pipe creates a barrier between the substances that flow through the metal pipe and the internal surface of the metal pipe.

According to one or more embodiments, the corrosion inhibitor solutions and corrosion-resistant films comprise a pyridinium hydroxyl alkyl ether compound having the structure of Chemical Structure #1.

Chemical Structure #1

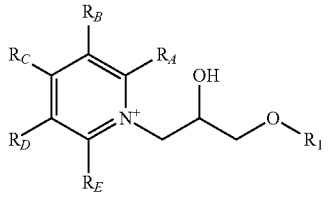

Referring to Chemical Structure #1, the general structure includes $R_1$, $R_A$, $R_B$, $R_C$, $R_D$, and $R_E$ that each represent various functional groups that can be included in the pyridinium hydroxyl alkyl ether compound. $R_1$ may be a $C_1$-$C_{18}$ alkyl group, a $C_1$-$C_{18}$ hydroxyl alkyl group, a $C_1$-$C_{18}$ alkenyl group, a $C_1$-$C_{18}$ alkynl group, a $C_1$-$C_{18}$ acryl group, a $C_1$-$C_{18}$ cycloalkyl group, or a $C_1$-$C_{18}$ functional alkyl group. $R_A$, $R_B$, $R_C$, $R_D$, and $R_E$ may each be independently chosen from hydrogen, a $C_1$-$C_{18}$ alkyl group, a $C_1$-$C_{18}$ hydroxyl alkyl group, a $C_1$-$C_{18}$ alkenyl group, a $C_1$-$C_{18}$ alkynl group, a $C_1$-$C_{18}$ acryl group, a $C_1$-$C_{18}$ cycloalkyl group, or a $C_1$-$C_{18}$ functional alkyl group. Without being bound by a theory, it is believed that one or more of $R_1$, $R_A$, $R_B$, $R_C$, $R_D$, and $R_E$ having a relatively long carbon chain moiety allows the corrosion-resistant film produced from the corrosion inhibitor solution to better adhere to the surface of a substrate. A "long carbon chain moiety" as used in the present disclosure refers to the specific groups of atoms that extend from the carbon backbone of the pyridinium hydroxyl alkyl ether compound. Further, if the carbon chain moiety has greater than 18 carbon atoms, there is an increased risk of the corrosion-resistant film being removed from the surface of the substrate.

In one or more embodiments, the term "functional group" or "group" may refer to a substituent or moiety that is present in the pyridinium hydroxyl alkyl ether compound. For example, when the disclosure states that $R_1$ may be a methyl group, the methyl group ($-CH_3$) replaces $R_1$ of the general structure of the pyridinium hydroxyl alkyl ether compound, where the carbon atom of the methyl group is now bonded to the oxygen atom of the pyridinium hydroxyl alkyl ether compound that $R_1$ was bonded to.

As described herein, moieties may be defined by the number of carbon atoms included in the moiety, such as $C_x$-$C_y$, where x is the least number of carbon atoms and y is the greatest number of carbon atoms contemplated. For example, $C_1$-$C_{18}$ describes a moiety that has from 1 to 18 carbon atoms.

In some embodiments, $R_1$, $R_A$, $R_B$, $R_C$, $R_D$, and $R_E$ may each independently be a $C_1$-$C_{18}$ alkyl group. The term "alkyl group" refers to a functional group that only contains carbon and hydrogen atoms where the carbon atoms and hydrogen atoms are only connected by single bonds. In some embodiments, $R_1$, $R_A$, $R_B$, $R_C$, $R_D$, and $R_E$ may each independently be a straight chained alkyl group having the chemical formula $-(CH_2)_xCH_3$, where x is from 0 to 17, such as 0 (a methyl group), 1, 2, 3, 4, 5, 6, 7, 8, 9, 10, 11, 12, 13, 14, 15, 16, or 17. In additional embodiments, $R_1$, $R_A$, $R_B$, $R_C$, $R_D$, and $R_E$ may each independently be branched alkyl groups having from 3 to 18 carbon atoms, such as 3, 4, 5, 6, 7, 8, 9, 10, 11, 12, 13, 14, 15, 16, 17, or 18 carbon atoms. In some embodiment, the alkyl group may include a ring structure, such as a pentane ring, a hexane ring, etc.

In some embodiments, $R_1$, $R_A$, $R_B$, $R_C$, $R_D$, and $R_E$ may each independently be a $C_1$-$C_{18}$ hydroxyl alkyl group. The term "hydroxyl alkyl group" refers to a functional group that includes one or more a hydroxyl moieties (–OH) bonded to an alkyl group. According to embodiments, the hydroxyl alkyl group may include 1, 2, 3, 4, 5, or even more hydroxyl moieties. In some embodiments, $R_1$, $R_A$, $R_B$, $R_C$, $R_D$, and $R_E$ may each independently be a straight chained hydroxyl alkyl group having the chemical formula $-(CH_2)_xOH$, where x is from 1 to 18. In additional embodiments, $R_1$, $R_A$, $R_B$, $R_C$, $R_D$, and $R_E$ may each independently be branched hydroxyl alkyl groups having from 1 to 18 carbon atoms and at least one hydroxyl group.

In some embodiments, $R_1$, $R_A$, $R_B$, $R_C$, $R_D$, and $R_E$ may each independently be a $C_1$-$C_{18}$ alkenyl group. The term "alkenyl group" refers to a functional group consisting of hydrogen and carbon atoms where at least two carbon atoms have a double bond. In some embodiments, the alkenyl group may have a single carbon to carbon double bond that is at the end of moiety (i.e., having the structure $-(CH_2)_x CH{=}CH_2$, where x is from 0 to 16, such as 0, 1, 2, 3, 4, 5, 6, 7, 8, 9, 10, 11, 12, 13, 14, 15, or 16).

In some embodiments, $R_1$, $R_A$, $R_B$, $R_C$, $R_D$, and $R_E$ may each independently be a $C_1$-$C_{18}$ alkynl group. The term "alkynyl group" refers to a functional group consisting of hydrogen and carbon atoms where at least two carbon atoms have a triple bond. In some embodiments, the alkynl group may have a single carbon to carbon triple bond that is at the end of moiety (i.e., having the structure $-(CH_2)_xC{=}CH$, where x is from 0 to 16, such as 0, 1, 2, 3, 4, 5, 6, 7, 8, 9, 10, 11, 12, 13, 14, 15, or 16).

In some embodiments, $R_1$, $R_A$, $R_B$, $R_C$, $R_D$, and $R_E$ may each independently be a $C_1$-$C_{18}$ acryl group. The term "acryl group" refers to a functional group consisting of a carbon-carbon double bond and a carbon-oxygen double bond separated by a carbon-carbon single bond. The acryl group may have the general formula $-(CH_2)_nCOCHCH_2$, where n is any integer from 0 to 15, such as 0, 1, 2, 3, 4, 5, 6, 7, 8, 9, 10, 11, 12, 13, 14, or 15.

In some embodiments, $R_1$, $R_A$, $R_B$, $R_C$, $R_D$, and $R_E$ may each independently be a $C_1$-$C_{18}$ functional alkyl group. The term "functional alkyl group" refers to an alkyl group which includes at least one moiety bonded to any carbon atom of the alkyl group. In some embodiments, the functional alkyl group may comprise more than one of the same moiety. In some embodiments, the functional alkyl group may comprise two or more different moieties. In some embodiments, the functional alkyl group may comprise a moiety chosen form a carboxyl group (i.e., –COOH), an amine group (i.e., $-NH_2$), or a thiol group (i.e., –SH).

In some embodiments, $R_1$ may be a $C_2$-$C_{17}$ alkyl group, and $R_A$, $R_B$, $R_C$, $R_D$, and $R_E$ may each be hydrogen. For example, $R_1$ may be a $C_4$-$C_{16}$ alkyl group, a $C_6$-$C_{14}$ alkyl group, or a $C_8$-$C_{12}$ alkyl group. In some embodiments, $R_1$ may be a $C_1$-$C_{17}$, a $C_1$-$C_{16}$, a $C_1$-$C_{15}$, a $C_1$-$C_{14}$, a $C_1$-$C_{13}$, a $C_1$-$C_{12}$, a $C_1$-$C_{11}$, a $C_1$-$C_{10}$, a $C_1$-$C_9$, a $C_1$-$C_8$, a $C_1$-$C_7$, a $C_1$-$C_6$, a $C_1$-$C_5$, a $C_1$-$C_4$, a $C_1$- $C_3$, or a $C_1$-$C_2$ alkyl group. In some embodiments, $R_1$ may be a $C_2$-$C_{18}$, $C_3$-$C_{18}$, $C_4$-$C_{18}$, $C_5$-$C_{18}$, $C_6$-$C_{18}$, $C_7$-$C_{18}$, $C_8$-$C_{18}$, $C_9$-$C_{18}$, $C_{10}$-$C_{18}$, $C_{11}$-$C_{18}$, $C_{12}$-$C_{18}$, $C_{13}$-$C_{18}$, $C_{14}$-$C_{18}$, $C_{15}$-$C_{18}$, $C_{16}$-$C_{18}$, or $C_{17}$-$C_{18}$ alkyl group. In one embodiment, $R_1$ may be a $C_{10}$ alkyl group (i.e., a decyl group) and $R_A$, $R_B$, $R_C$, $R_D$, and $R_E$ may each be hydrogen.

In one or more embodiments, the corrosion inhibitor compound 100 may comprise from 10 wt.% to 30 wt.% of the pyridinium hydroxyl alkyl ether compound. In some embodiments, the corrosion inhibitor compound 100 may comprise from 10 wt.% to 20 wt.%, from 10 wt.% to 15 wt.%, from 15 wt.% to 30 wt.%, from 15 wt.% to 20 wt.%, from 15 wt.% to 25 wt.%, or from 10 wt.% to 25 wt.% of the pyridinium hydroxyl alkyl ether compound.

Without being bound by a theory, it is believed that the pyridinium hydroxyl alkyl ether compound has relatively strong bonding to a metal surface due to both the physisorption and chemisorption of multiple parts of the pyridinium hydroxyl alkyl ether compound and the metal surface. The term "physisorption" refers to the physical bonding of liquid molecules onto a material's surface. Van der Waal interactions, or similar interactions, between atoms on the surface of a metal may cause these surface atoms to be reactive, thus causing them to attract molecules to satisfy the atomic force imbalance. It is believed that the presence of the positively-charged nitrogen atom of the pyridinium hydroxyl alkyl ether compound forms strong Van der Waal, or similar, interactions with the metal surface. The term "chemisorption" refers to the adsorption between a surface and an adsorbate due to chemical bonding. Multiple parts of the pyridinium hydroxyl alkyl ether compound including, but not limited to, hydroxyl groups, ether groups, and pyridinium groups may bond with the metal surface. It is believed that due to the increased number of functional groups on the pyridinium hydroxyl alkyl ether compound that can interact with a metal surface through physisorption and/or chemisorption, the corrosion-resistant inhibitor 100 that comprises the pyridinium hydroxyl alkyl ether compound forms stronger interactions and bonds with a metal surface and, thus, provides the metal surface with a stronger and longer lasting corrosion-resistant inhibitor 100 than many conventional films that use conventional compounds for resisting corrosion on a metal surface.

The present disclosure is also directed to methods of reducing corrosion during petroleum transportation, petroleum storage, or both. The methods of reducing corrosion during petroleum transportation, petroleum storage, or both, may comprise inputting a corrosion inhibitor formulation into a petroleum pipeline, a petroleum storage tank, or both, wherein the corrosion inhibitor formulation consists essentially of solvent and a pyridinium hydroxyl alkyl ether compound.

In one or more embodiments, the method may further comprise transporting the petroleum in a petroleum pipeline to a destination.

EXAMPLES

Examples are provided herein which may disclose one or more embodiments of the present disclosure. However, the Examples should not be viewed as limiting on the claimed embodiments hereinafter provided.

EXAMPLE 1—SYNTHESIS OF 1-[3-(DECYLOXY)-2-HYDROXYPROPYL] PYRIDINIUM CHLORIDE

Pyridine (1.5 mol) and hydrochloric acid (1 mol) were added to a round bottom flask and purged with nitrogen and stirred at room temperature (25° C.) for 10 minutes. Then, octyl/decyl glycidyl ether (1 mol) was added to the flask and again stirred for 30 minutes and then the contents of the flask were heated at 110° C. for 6 hours. At the end of this elapsed time, excess pyridine was removed from the final solution using a rotavapor.

Figure 2:
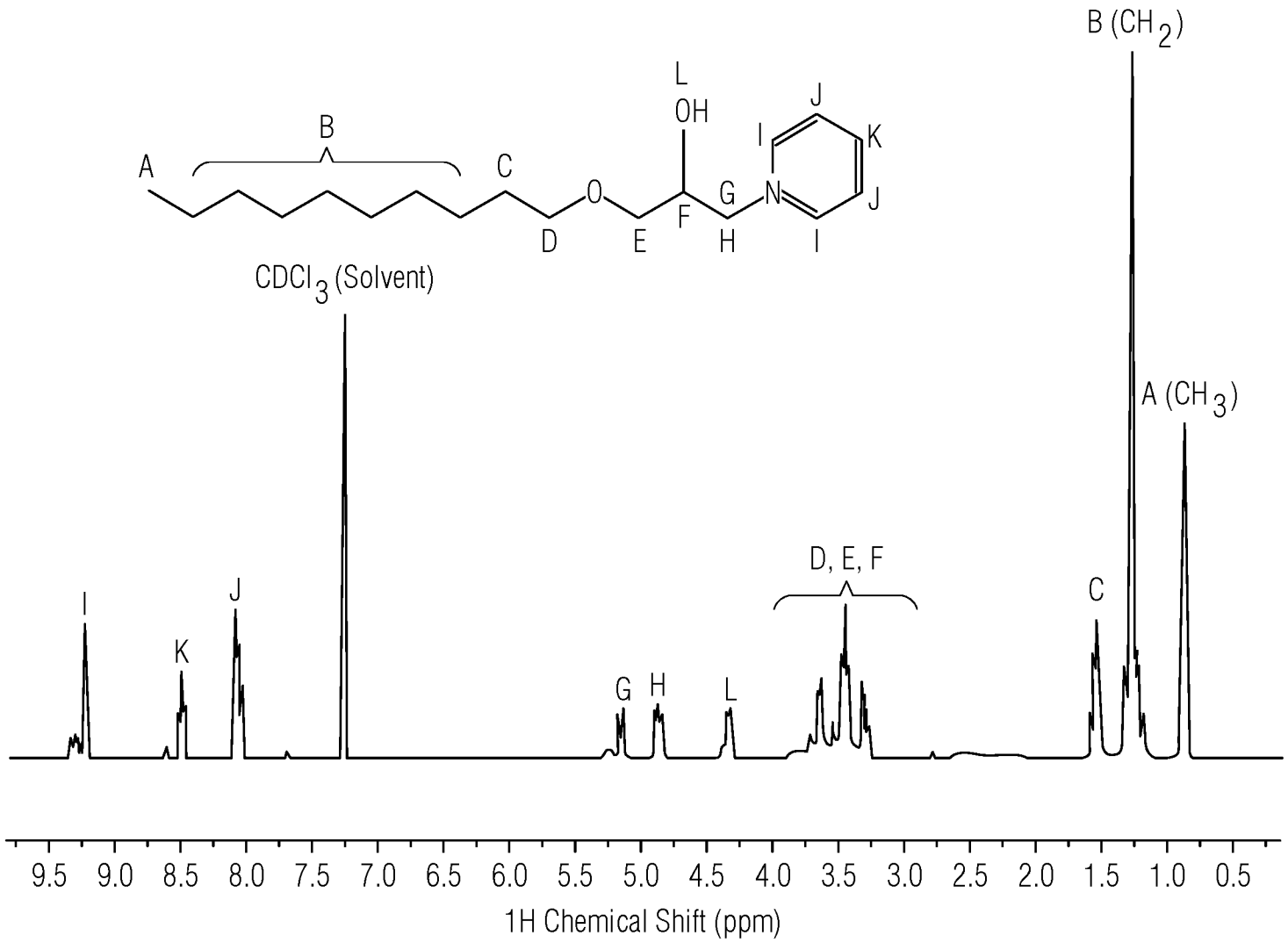
FIG. 2 graphically depicts the H-NMR spectrum of a synthesized pyridinium hydroxyl alkyl ether compound (1-[3-(decyloxy)-2-hydroxypropyl] pyridinium chloride), according to one or more embodiments shown and described herein.
Figure 3:
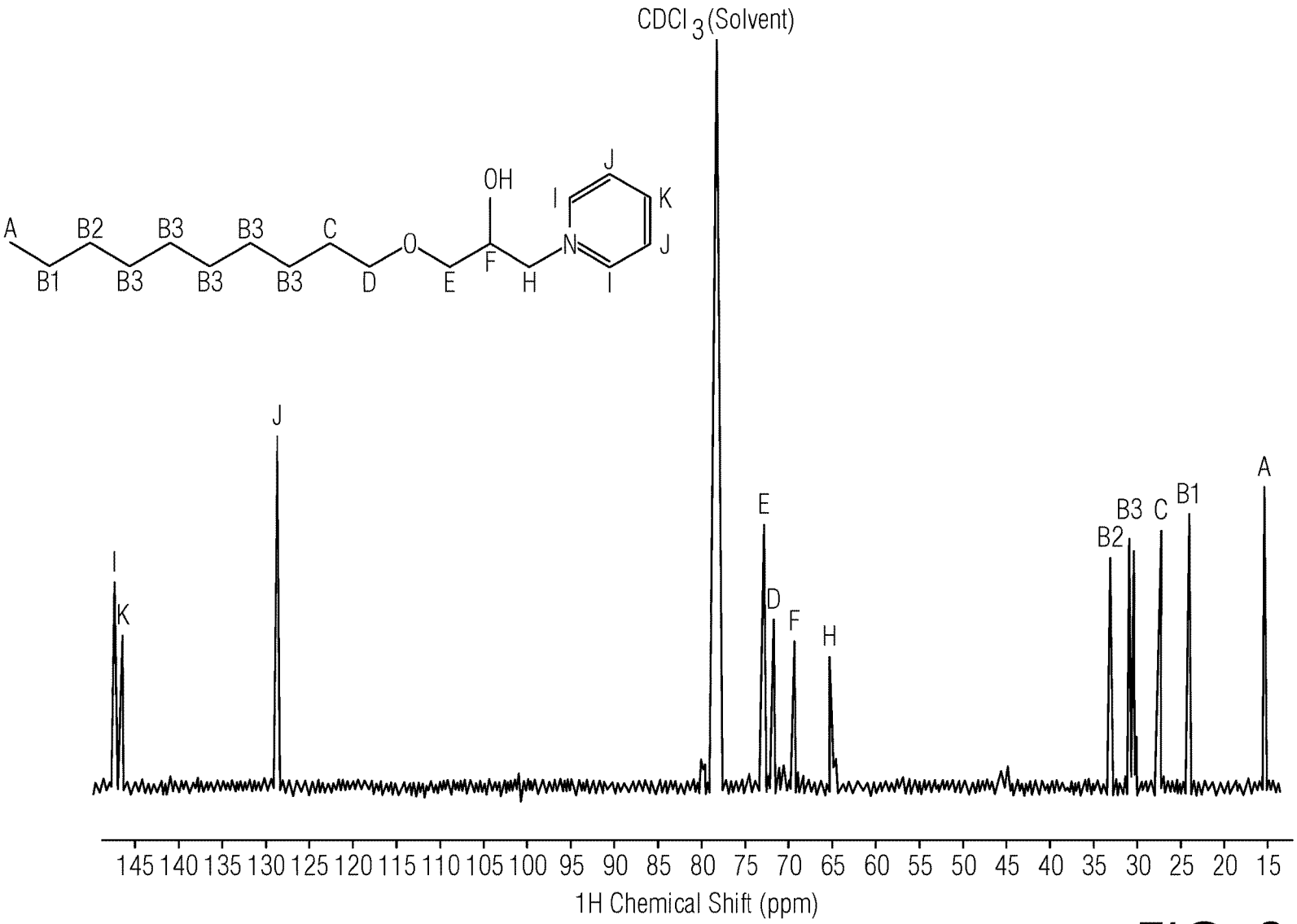
FIG. 3 graphically depicts the C-NMR spectrum of a synthesized pyridinium hydroxyl alkyl ether compound (1-[3-(decyloxy)-2-hydroxypropyl] pyridinium chloride), according to one or more embodiments shown and described herein.

The final solution was added to a separating funnel and dichloromethane ($CH_2Cl_2$) and a saturated solution of NaCl in water and potassium carbonate ($K_2CO_3$) was added to separate the organic and aqueous phases. The organic phase was collected and a rotavapor was used to remove the organic solvent and dark brown gel-like 1-[3-(decyloxy)-2-hydroxypropyl] pyridinium chloride was collected. FIG. 2 provides the H-NMR spectrum and FIG. 3 provides the C-NMR spectrum of this formed 1- [3-(decyloxy)-2-hydroxypropyl] pyridinium chloride.

The pyridine, octyl/decyl glycidyl ether, hydrochloric acid (37%), dichloromethane, and diethyl ether were purchased from Sigma-Aldrich and used without any further purification.

EXAMPLE 2—COMPOSITION OF CORROSION INHIBITOR COMPOUND

The following table, Table 1, discloses a corrosion inhibitor solution that comprises 1-[3-(decyloxy)-2-hydroxypropyl] pyridinium chloride that was used for performance evaluation.

TABLE 1

Corrosion inhibitor solution Composition based on Pyridinium Compound

| Component Function | Components Name | Weight % |
|---|---|---|
| Solvent | Water | 80.00 |
| Corrosion Inhibitors | Pyridinium Compound = 1-[3-(Decyloxy)-2-hydroxypropyl] pyridinium chloride | 20.00 |
| | Total | 100.0 |

EXAMPLE 3—PERFORMANCE EVALUATION OF A CORROSION-RESISTANT FILM COMPRISING 1-[3-(DECYLOXY)-2-HYDROXYPROPYL] PYRIDINIUM CHLORIDE

The National Association of Corrosion Engineers (NACE) is a standard established in 1943 for the corrosion control industry to protect people, assets and the environment from the adverse effects of corrosion. NACE provides a method for evaluating the performance of corrosion inhibitor efficiency for petroleum product pipelines through NACE standard TM 0172. This standard provides a test method to determine the corrosive properties of liquid petroleum products (e.g., gasoline and distillate fuels), and other liquid hydrocarbon products that are not water soluble, for transport through a steel pipeline.

The TM 0172 test requires rotating steel test specimens at 1000 rpm in the presence of hydrocarbon, distilled water, and air. Following the contact time of 4 hours at 38° C., the steel test specimen was examined for corrosion. The ratings corresponding to measured corrosion are provided in Table 2 below. A NACE rating of B+ or better is generally required for transportation of hydrocarbon via pipeline.

TABLE 2

Rating of the Test Specimen
Rating of Test Specimen According to NACE TM0172

| Rating | % of Test Surface Corroded |
|---|---|
| A | 0 |
| $B^{++}$ | Less than 0.1 (2 or 3 Spots of no more than 1 mm diameter) |
| $B^{+}$ | Less than 5 |
| B | 5 to 25 |
| C | 25 to 50 |
| D | 50 to 75 |
| E | 75 to 100 |

In Example 3, two steel test specimens were analyzed consistent with the NACE TM 0172. One steel test specimen had no corrosion inhibitor while the other steel test specimen had a corrosion inhibitor solution that comprises 1-[3-(decyloxy)-2-hydroxypropyl] pyridinium chloride at 100 ppm.

Each steel test specimen followed the same testing procedure: 300 mL of gasoline was added to a test breaker and heated until the temperature of the gasoline reached 38±1° C. (100 ±2° F.). Upon reaching this temperature, the steel test specimen was inserted into the gasoline. The steel test specimen was stirred at 1,000±50 rpm for 30 minutes to ensure complete wetting of the steel test specimen With the stirrer in motion, the temperature measuring device was removed temporarily and 30 mL of distilled water was added to the bottom of the beaker. The distilled water was added to the bottom of the beaker by injecting the water with a syringe through a needle. Then, the temperature measuring device was replaced in the gasoline-water mixture.

The gasoline-water mixture was continuously stirred at a speed of 1,000±50 rpm for 3.5 hours from the time the water was added, maintaining the temperature of the gasoline-water mixture at 38±1° C. (100±2° F.). At the end of the 3.5 hour period, the stirring was stopped. The steel test specimen was removed, drained from the gasoline-water mixture, and then washed with toluene followed by acetone.

The ultimate rating that was calculated was based on that portion of the test specimen that had changed. The results obtained from the NACE TM 0172 method with and without corrosion inhibitor are presented below in Table 3.

TABLE 3

NACE spindle test data of Pyridinium alkyl ether

| Experimental System | Concentration (ppm) | % Corroded area | Rating |
|---|---|---|---|
| Blank | N/A | 86 | E |
| Pyridinium alkyl ether-based | 100 ppm | 0.1 | B++ |

As seen above in Table 3, the developed corrosion inhibitor (Pyridinium alkyl ether-based) provided excellent corrosion inhibition efficiency with a B++ rating and 0.1% corroded area. Comparatively, a steel test specimen with no corrosion inhibitor resulted in 86% corroded area, or an E rating.

Further analysis was performed on the results of the NACE TM 0172 method test. The corrosion inhibition efficiency of the developed formulation is presented in Table 4 below. The corrosion inhibition efficiency (IE) of each inhibitor was calculated using the following equation:

$$\text{Inhibition Efficiency (\%)} = \left(\frac{\text{corrosion rate without inhibtor} - \text{corrosion rate with inhibitor}}{\text{corrosion rate without inhibitor}}\right) \times 100$$

The performance evaluations of the developed corrosion inhibitor given in Table 4 and Table 5 below were evaluated using an electrochemical method with Tafel Polarization and Electrochemical Impedance spectroscopy. The electrochemical experiments were made using a conventional three-electrode cell assembly at 25° C. The working electrode was a steel (C1018) sample of a 9-$cm^2$ area, and the rest was covered with Araldite epoxy. A large rectangular platinum foil was used as a counter electrode and a saturated calomel electrode as the reference electrode. The working electrode was polished with different grades of emery papers, washed with water, and degreased with trichloroethylene. The polarization and impedance studies were made after 30 min of immersion using Gamry Instruments (Model 1010E). The polarization was carried out using Gamry software from a cathodic potential of −0.2 V to an anodic potential of +0.2 V, with respect to the corrosion potential at a sweep rate of 0.167 mV/s in accordance with American Society for Testing and Materials (ASTM) method G59-97.

The impedance measurements were carried out using alternating current signals of 10 mV amplitude for the frequency spectrum from 100 kHz to 0.01 Hz. Diesel and water containing 120 ppm chloride ion were combined in the ratio of 2:1 as a test solution. In each system, two steel specimens were immersed and stirred vigorously for seven days. After the test period, electrochemical tests were carried out in a special cell containing an aqueous medium collected from the experimental system. Impedance and polarization were carried out by employing water used after seven days period of the stirring system. Based on experimental results, we claimed that the developed formulation provided high corrosion inhibition efficiency in petroleum product pipeline conditions (i.e., 25° C. and 120 ppm of Chloride in water).

Figure 4:
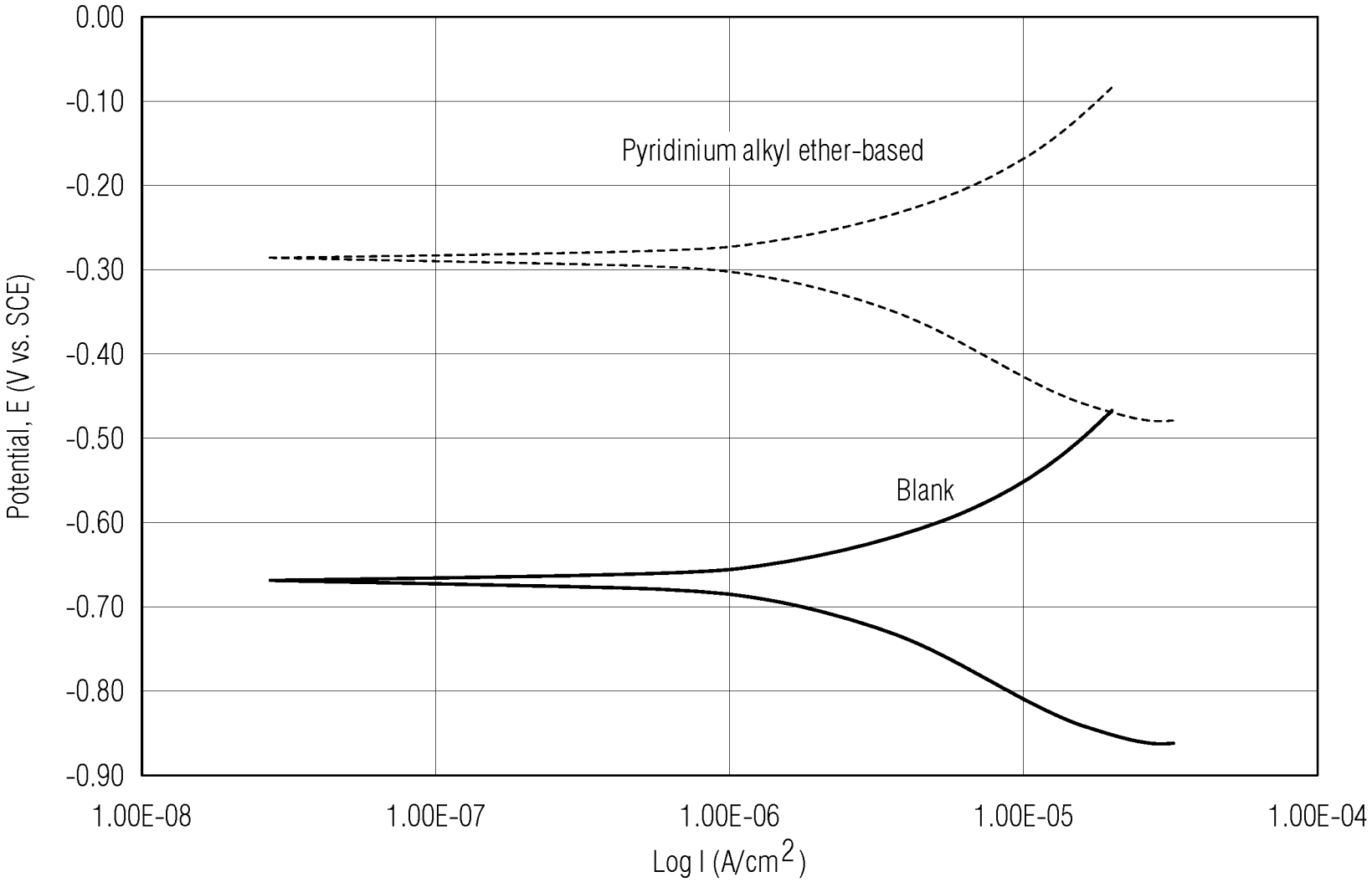
FIG. 4 graphically depicts the potentiodynamic polarization analysis of the pyridinium-based compound and blank (without corrosion inhibitor) in diesel-water (2:1 ratio) mixtures at 25° C.

FIG. 4 illustrates a Potentiodynamic polarization test as performed on steel with and without a corrosion inhibitor. Potentiodynamic polarization is a term describing the measured change in the electrical potential (voltage) of a system. More specifically, a Potentiodynamic polarization test refers to a polarization technique in which the potential of an electrode is varied over a relatively large potential domain at a selected rate by the application of a current through the electrolyte.

Referring now to FIG. 4, the Potentiodynamic polarization behavior in the Tafel region for steel (C1018) in diesel-water mixture in the ratio of 2:1, with and without the addition of 1-[3-(Decyloxy)-2-hydroxypropyl] pyridinium chloride is shown. The corrosion kinetic parameters such as corrosion potential ($E_{corr}$), corrosion current density ($i_{corr}$) and Tafel constants ($b_a$ and $b_c$) derived from the potentiodynamic curves are presented in Table 4. The corrosion current density ($i_{corr}$) values decreased from 4.51 μA/cm$^2$ of the blank to 0.105 μA/cm$^2$, in the addition of 100 ppm concentrations of synthesized compound {1-[3-(Decyloxy)-2-hydroxypropyl] pyridinium chloride}.

The data in the Tafel region (−0.2 to +0.2 V versus corrosion potential) have been processed for the evaluation of corrosion kinetic parameters. The linear Tafel segments of the anodic and cathodic curves were extrapolated to corrosion potential for obtaining the corrosion current values.

TABLE 4

Potentiodynamic Polarization Analysis of Carbon Steel (C1018)

| Experimental System | Concentration (PPM) | $E_{corr}$ (mV) | $b_a$ (mV/dec) | $b_c$ (mV/dec) | $I_{corr}$ (μA/cm$^2$) | Corrosion Rate (mpy) | Inhibition Efficiency (%) |
|---|---|---|---|---|---|---|---|
| Blank (without corrosion inhibitor) | N/A | −618 | 281 | 400 | 4.51 | 2.062 | N/A |
| Pyridinium alkyl ether-based | 100 | −267 | 324 | 205 | 0.105 | 0.048 | 98 |

As shown in Table 4, a 98% corrosion inhibition was attained with the synthesized 1-[3-(Decyloxy)-2-hydroxypropyl] pyridinium chloride at a 100 ppm concentration. Additionally, the corrosion rate was 0.048 mpy with synthesized 1-[3-(Decyloxy)-2-hydroxypropyl] pyridinium chloride, when compared to the blank corrosion rate of 2.062 mpy in gasoline-water mixtures at 25° C. Thus, the metal surfaces in the petroleum products transporting pipelines and storage tanks can be protected by adding the disclosed pyridinium based compounds as a corrosion inhibitor.

Figure 5:
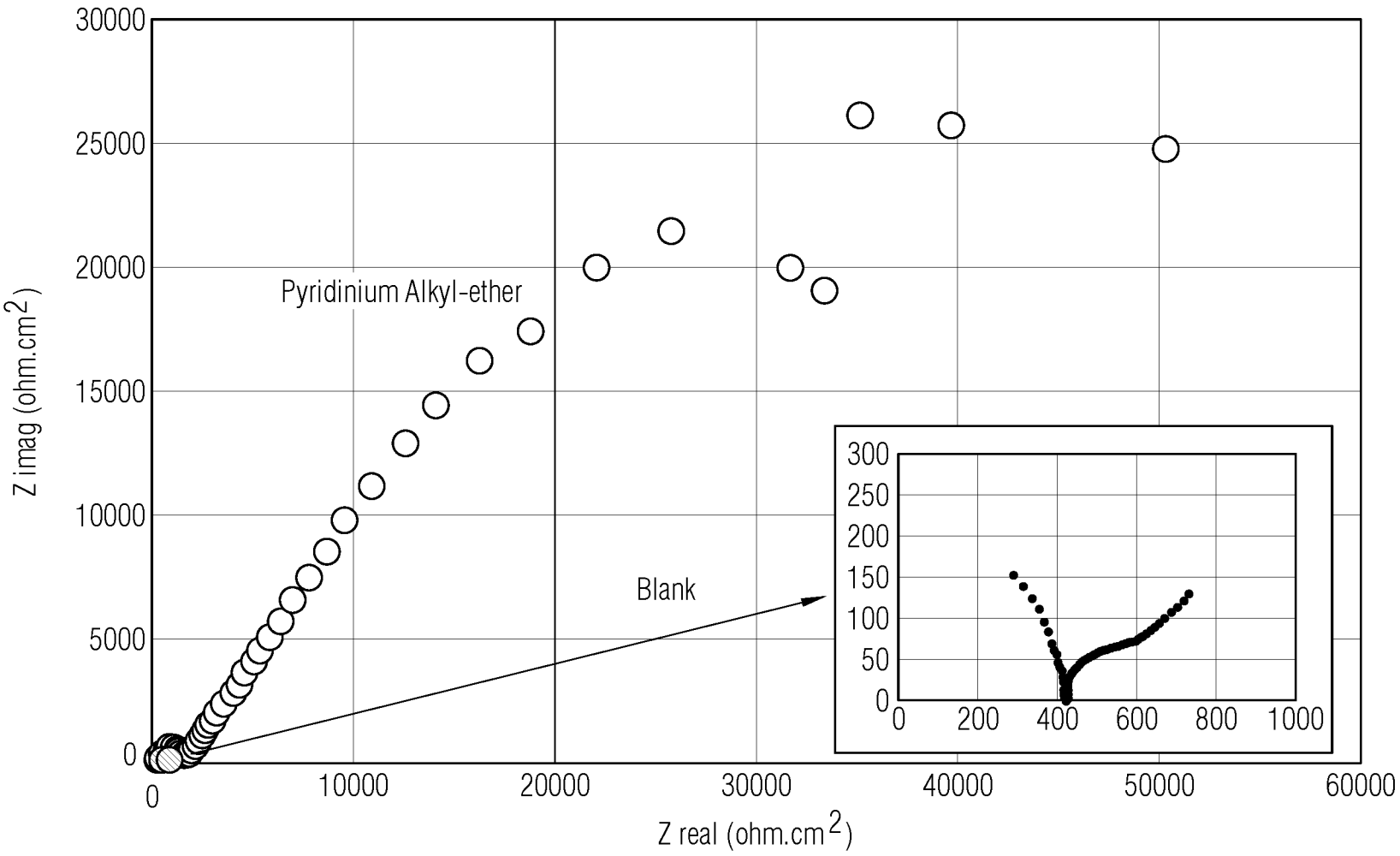
FIG. 5 graphically depicts a Nyquist plot diagrams of carbon steel C1018 in diesel-water mixtures in presence and absence of Pyridinium alkyl ether-based compound at 25° C.

Electrochemical analysis is the most effective and reliable method to investigate corrosion reactions. FIG. 5 and Table 5 show the Nyquist plot of the impedance values of the steel (C1018) in diesel-water mixtures with and without the addition of Pyridinium alkyl ether-base.

TABLE 5

Electrochemical Impedance Parameters of the Carbon Steel (C1018)

| Experimental System | Solution Resistance, Rs (Ohm · cm$^2$) | Charge Transfer resistance, Rct (Ohm · cm$^2$) | Total Resistance, RT (Ohm · cm$^2$) | Corrosion Inhibition (%) |
|---|---|---|---|---|
| Blank (without corrosion inhibitor) | 289 | 734 | 445 | N/A |
| Pyridinium alkyl ether-based | 182 | 50470 | 50288 | 99 |

FIG. 5 shows that the Nyquist plot with and without the corrosion inhibitor. A Nyquist plot is a graphical presentation of the real part and the imaginary part of an impedance Z over a specified frequency range. In Cartesian coordinates, the real part of a transfer function is plotted on the X-axis while the imaginary part is plotted on the Y-axis. The frequency is swept as a parameter, resulting in a plot per frequency. Referring now to FIG. 5, the developed pyridinium alkyl ether-based compound showed higher diameter compared to the blank system (without a corrosion inhibitor), which indicates that the newly developed compounds showed higher corrosion inhibition efficiency (99%) in diesel-water mixtures at 25° C.

As shown in Table 5, the blank system showed very little resistance (445 ohm.cm$^2$) whereas the synthesized compound showed high resistance (50288 ohm.cm$^2$). This difference indicates that the electrode impedance greatly was increased by addition of the Pyridinium alkyl ether-based compound when compared to blank experiment. Additionally, the capacitance value was lower in the corrosion inhibitor system.

The present disclosure includes one or more non-limiting aspects. A first aspect includes a method of reducing corrosion during petroleum transportation, petroleum storage, or both, the method comprising inputting a corrosion inhibitor formulation into a petroleum pipeline, a petroleum storage tank, or both, wherein the corrosion inhibitor formulation consists essentially of solvent and a pyridinium hydroxyl alkyl ether compound having a general formula:

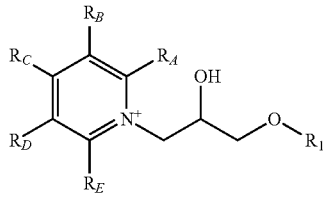

wherein $R_1$ is a $C_1$-$C_{18}$ alkyl group, a $C_1$-$C_{18}$ hydroxyl alkyl group, a $C_1$-$C_{18}$ alkenyl group, a $C_1$-$C_{18}$ alkynl group, a $C_1$-$C_{18}$ acryl group, a $C_1$-$C_{18}$ cycloalkyl group, or a $C_1$-$C_{18}$ functional alkyl group; and wherein $R_A$, $R_B$, $R_C$, $R_D$, and $R_E$ are each independently chosen from hydrogen, a $C_1$-$C_{18}$ alkyl group, a $C_1$-$C_{18}$ hydroxyl alkyl group, a $C_1$-$C_{18}$ alkenyl group, a $C_1$-$C_{18}$ alkynl group, a $C_1$-$C_{18}$ acryl group, a $C_1$-C_cycloalkyl group, or a $C_1$-$C_{18}$ functional alkyl group.

A second aspect includes any above aspect, wherein the $C_1$-$C_{18}$ functional alkyl group comprises a moiety chosen from a carboxyl group, an amine group, or a thiol group.

A third aspect includes any above aspect, wherein the petroleum pipeline is a metal pipe.

A fourth aspect includes any above aspect, wherein the petroleum comprises any of gasoline, diesel, kerosene, or jet fuel.

A fifth aspect includes any above aspect, wherein the corrosion inhibitor formulation comprises from 10 wt.% to 30 wt.% of the pyridinium hydroxyl alkyl ether compound.

A sixth aspect includes any above aspect, wherein the corrosion inhibitor formulation comprises 70 wt.% to 90 wt.% solvent.

A seventh aspect incudes any above aspect, wherein the solvent comprises water, an alcohol, aromatic naphtha, or combinations thereof An eighth aspect includes any above aspect, wherein the corrosion inhibitor formulation has a corrosion rate of less than 0.1 mpy.

A ninth aspect includes any above aspect, wherein the corrosion inhibitor formulation has an inhibition efficiency greater than 95% at 25° C., where the inhibition efficiency is calculated by the following equation:

$$\text{Inhibition Efficiency (\%)} = \left(\frac{\text{Corrosion Rate Without Inhibtor} - \text{Corrosion Rate With Inhibitor}}{\text{Corrosion Rate Without Inhibitor}}\right) \times 100.$$

A tenth aspect includes any above aspect, wherein the corrosion inhibitor formulation has a total resistance of at least 50,000 Ohm.cm$^2$ at 25° C.

An eleventh aspect includes any above aspect, wherein $R_1$ is a decyl group and $R_A$, $R_B$, $R_C$, $R_D$, and $R_E$ are hydrogen.

A twelfth aspect includes any above aspect, wherein the method further comprises transporting the petroleum in the petroleum pipeline to a destination.

The subject matter of the present disclosure has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

It is noted that one or more of the following claims utilize the term "wherein" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that where a first component is described as "comprising" a second component, it is contemplated that, in some embodiments, the first component "consists" or "consists essentially of" that second component. It should further be understood that where a first component is described as "comprising" a second component, it is contemplated that, in some embodiments, the first component comprises at least 10%, at least 20%, at least 30%, at least 40%, at least 50%, at least 60%, at least 70%, at least 80%, at least 90%, at least 95%, or even at least 99% that second component (where % can be weight % or molar %).

It is also noted that recitations herein of "at least one" component, element, etc., should not be used to create an inference that the alternative use of the articles "a" or "an" should be limited to a single component, element, etc.

For the purposes of describing and defining the presently disclosed technology it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

What is claimed is:

1. A method of reducing corrosion during petroleum transportation, petroleum storage, or both, the method comprising:

inputting a corrosion inhibitor formulation into a petroleum pipeline, a petroleum storage tank, or both, wherein the corrosion inhibitor formulation consists essentially of solvent and a pyridinium hydroxyl alkyl ether compound having a general formula:

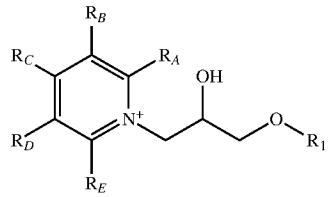

wherein $R_1$ is a $C_1$-$C_{18}$ alkyl group, a $C_1$-$C_{18}$ hydroxyl alkyl group, a $C_1$-$C_{18}$ alkenyl group, a $C_1$-$C_{18}$ alkynl group, a $C_1$-$C_{18}$ acryl group, a $C_1$-$C_{18}$ cycloalkyl group, or a $C_1$-$C_{18}$ functional alkyl group; and wherein $R_A$, $R_B$, $R_C$, $R_D$, and $R_E$ are each independently chosen from hydrogen, a $C_1$-$C_{18}$ alkyl group, a $C_1$-$C_{18}$ hydroxyl alkyl group, a $C_1$-$C_{18}$ alkenyl group, a $C_1$-$C_{18}$ alkynl group, a $C_1$-$C_{18}$ acryl group, a $C_1$-$C_{18}$ cycloalkyl group, or a $C_1$-$C_{18}$ functional alkyl group.

2. The method of claim 1, wherein the $C_1$-$C_{18}$ functional alkyl group comprises a moiety chosen from a carboxyl group, an amine group, or a thiol group.

3. The method of claim 1, wherein the petroleum pipeline is a metal pipe.

4. The method of claim 1, wherein the petroleum comprises any of gasoline, diesel, kerosene, or jet fuel.

5. The method of claim 1, wherein the corrosion inhibitor formulation comprises from 10 wt.% to 30 wt.% of the pyridinium hydroxyl alkyl ether compound.

6. The method of claim 1, wherein the corrosion inhibitor formulation comprises 70 wt.% to 90 wt.% solvent.

7. The method of claim 1, wherein the solvent comprises water, an alcohol, aromatic naphtha, or combinations thereof.

8. The method of claim 1, wherein the corrosion inhibitor formulation has a corrosion rate of less than 0.1 mpy.

9. The method of claim 1, wherein the corrosion inhibitor formulation has an inhibition efficiency greater than 95% at 25° C., where the inhibition efficiency is calculated by the following equation:

$$\text{Inhibition Efficiency (\%)} = \left(\frac{\text{Corrosion Rate Without Inhibitor} - \text{Corrosion Rate With Inhibitor}}{\text{Corrosion Rate Without Inhibitor}}\right) \times 100.$$

10. The method of claim 1, wherein the corrosion inhibitor formulation has a total resistance of at least 50,000 Ohm.cm$^2$ at 25° C.

11. The method of claim 1, wherein $R_1$ is a decyl group and $R_A$, $R_B$, $R_C$, $R_D$, and $R_E$ are hydrogen.

12. The method of claim 1, the method further comprising transporting the petroleum in the petroleum pipeline to a destination.

* * * * *